US010695601B2

(12) United States Patent
Souffrain

(10) Patent No.: US 10,695,601 B2
(45) Date of Patent: Jun. 30, 2020

(54) EXERCISE ACCESSORY, SYSTEM AND METHOD

(71) Applicant: Juan Ernesto Souffrain, Cliffside Park, NJ (US)

(72) Inventor: Juan Ernesto Souffrain, Cliffside Park, NJ (US)

( * ) Notice: Subject to any disclaimer, the term of this patent is extended or adjusted under 35 U.S.C. 154(b) by 150 days.

(21) Appl. No.: 15/429,177

(22) Filed: Feb. 10, 2017

(65) Prior Publication Data

US 2018/0126212 A1 May 10, 2018

Related U.S. Application Data

(60) Provisional application No. 62/418,421, filed on Nov. 7, 2016.

(51) Int. Cl.

| | |
|---|---|
| ***A63B 1/00*** | (2006.01) |
| ***A63B 71/00*** | (2006.01) |
| ***A63B 23/12*** | (2006.01) |
| ***A63B 21/068*** | (2006.01) |

(52) U.S. Cl.

CPC ..... *A63B 1/00* (2013.01); *A63B 21/068* (2013.01); *A63B 23/1218* (2013.01); *A63B 71/0036* (2013.01); *A63B 2071/0072* (2013.01); *A63B 2209/00* (2013.01); *A63B 2210/50* (2013.01)

(58) Field of Classification Search

CPC ... A63B 1/00; A63B 23/1218; A63B 71/0036; A63B 21/068; A63B 2209/00; A63B 2071/0072; A63B 2210/50

See application file for complete search history.

(56) References Cited

U.S. PATENT DOCUMENTS

| | | | | | |
|---|---|---|---|---|---|
| 843,478 | A * | 2/1907 | Müller | A63B 21/0552 | 482/124 |
| 2,574,178 | A * | 11/1951 | Haller | A62B 35/0031 | 182/3 |
| 3,593,708 | A * | 7/1971 | Steele | A61H 1/0218 | 602/32 |
| 4,527,289 | A * | 7/1985 | Shea | A41F 9/002 | 2/322 |
| 4,685,671 | A * | 8/1987 | Hagerman | A63B 21/04 | 482/124 |
| 4,826,153 | A * | 5/1989 | Schalip | A63B 21/06 | 482/94 |
| 4,984,786 | A * | 1/1991 | Lemke | A63B 21/4001 | 482/105 |
| 5,048,825 | A * | 9/1991 | Kelly | A63B 21/154 | 482/904 |
| 5,147,261 | A * | 9/1992 | Smith | A61F 5/028 | 2/338 |
| 5,201,694 | A * | 4/1993 | Zappel | A63B 21/00072 | 482/133 |

(Continued)

*Primary Examiner* — Garrett K Atkinson

(74) *Attorney, Agent, or Firm* — Acumen Intellectual Property; Michael Christopher Balaguy

(57) ABSTRACT

An accessory includes a support hook, a hand grip, and an arm support. Also disclosed herein is an exercise system including a left exercise accessory, a right exercise accessory and an exercise support having a first vertical support, a second vertical support, a first horizontal bar and a second horizontal bar. The exercise system is useful for providing a means to perform abdominal exercise on a horizontal bar in a variety of settings.

16 Claims, 5 Drawing Sheets

(56) References Cited

U.S. PATENT DOCUMENTS 5,279,386 A * 1/1994 Cearley ..... A62B 35/0031 119/907
5,290,209 A * 3/1994 Wilkinson ..... A63B 21/00047 482/121
5,318,495 A * 6/1994 Malynowsky ..... A63B 21/023 482/129
5,362,295 A * 11/1994 Nurge ..... A63B 21/00061 482/121
5,399,139 A * 3/1995 Malynowsky ..... A63B 21/023 248/188.7
5,403,253 A * 4/1995 Gaylord ..... A63B 21/068 482/140
5,411,461 A * 5/1995 Thomascik ..... A63C 3/00 280/1.5
5,518,486 A * 5/1996 Sheeler ..... A63B 21/0004 482/131
5,662,556 A * 9/1997 Gangloff ..... A63B 1/005 482/17
5,810,702 A * 9/1998 Wilkinson ..... A63B 21/00047 482/130
5,848,956 A * 12/1998 Grettner ..... A61F 5/3738 482/69
5,871,424 A * 2/1999 Conner ..... A63B 21/0552 482/121
6,050,364 A * 4/2000 Popall ..... A62B 35/0031 182/6
7,032,529 B2 * 4/2006 Sanford ..... B63B 21/00 114/230.2
7,255,666 B2 * 8/2007 Cardenas ..... A61H 1/0229 482/143
7,503,736 B1 * 3/2009 Chen ..... B60P 7/083 410/100
7,540,831 B2 * 6/2009 Hauser ..... A63B 1/00 482/40
7,575,136 B2 * 8/2009 Kernkamp ..... A45F 3/14 224/158
7,811,202 B2 * 10/2010 Planke ..... A63B 21/068 482/7
8,038,584 B1 * 10/2011 Pruessner ..... A61H 1/02 482/143
8,152,704 B2 * 4/2012 Brice ..... A63B 21/00 482/129
8,197,392 B2 * 6/2012 Silverman ..... A63B 7/00 482/904
8,267,840 B2 * 9/2012 Barnes ..... A63B 21/00 482/131
8,678,983 B1 * 3/2014 Brown ..... A63B 21/4033 482/131
8,858,408 B2 * 10/2014 DeMeo ..... A63B 21/00185 482/131
8,920,294 B2 * 12/2014 Davis ..... A63B 21/068 482/143
9,375,596 B2 * 6/2016 Davis ..... A63B 21/068
9,504,867 B2 * 11/2016 Hall ..... A63B 21/0726
9,573,015 B2 * 2/2017 Hall ..... A63B 21/0726
9,821,188 B2 * 11/2017 Dwork ..... A63B 21/16
9,884,239 B2 * 2/2018 Kay ..... A63B 21/153
10,245,460 B2 * 4/2019 Hetrick ..... A63B 23/0355
10,252,099 B2 * 4/2019 Karpachevskyy ..... A63B 21/1636
2003/0027698 A1 * 2/2003 Matsuoka ..... A63B 21/0004 482/124
2003/0078142 A1 * 4/2003 Jacobsen ..... A63B 21/0552 482/126
2003/0130098 A1 * 7/2003 Marco ..... A63B 21/0004 482/124
2005/0227833 A1 * 10/2005 Wilkinson ..... A63B 21/0004 482/124
2005/0251895 A1 * 11/2005 Farrah ..... A41D 1/08 2/227
2006/0052222 A1 * 3/2006 Cardenas ..... A61H 1/0229 482/96
2007/0213186 A1 * 9/2007 Longo ..... A63B 21/0552 482/121
2009/0111661 A1 * 4/2009 Hauser ..... A63B 1/00 482/40
2010/0292058 A1 * 11/2010 Barnes ..... A63B 21/00 482/139
2011/0166003 A1 * 7/2011 Brice ..... A63B 21/00 482/131
2012/0035031 A1 * 2/2012 Silverman ..... A63B 7/00 482/139
2012/0202660 A1 * 8/2012 Silverman ..... A63B 7/00 482/131
2012/0214651 A1 * 8/2012 Ross ..... A63B 21/0442 482/129
2013/0143724 A1 * 6/2013 DeMeo ..... A63B 21/00185 482/131
2013/0217547 A1 * 8/2013 Hinds ..... A63B 7/00 482/96
2014/0005015 A1 * 1/2014 Hester ..... A63B 21/154 482/131
2014/0073493 A1 * 3/2014 Parish ..... A63B 21/0724 482/104
2014/0073496 A1 * 3/2014 Bannerman ..... A63B 21/0552 482/139
2015/0024911 A1 * 1/2015 Ross ..... A63B 21/0442 482/129
2015/0045194 A1 * 2/2015 Sheets ..... A63B 21/0442 482/139
2015/0057133 A1 * 2/2015 Nguyen ..... A63B 21/4019 482/93
2016/0023051 A1 * 1/2016 Lauener ..... A61H 1/0229 482/143
2016/0263461 A1 * 9/2016 Kay ..... A63B 21/0783
2016/0303419 A1 * 10/2016 Karpachevskyy ..... A63B 21/1636
2018/0071574 A1 * 3/2018 Reder ..... A63B 23/0205
2018/0085622 A1 * 3/2018 Ivan ..... A63B 21/1627
2018/0140886 A1 * 5/2018 Hetrick ..... A63B 21/04
2018/0272177 A1 * 9/2018 Negron ..... A63B 21/04
2019/0091507 A1 * 3/2019 Hetrick ..... A63B 21/151

* cited by examiner

EXERCISE ACCESSORY, SYSTEM AND METHOD

CROSS-REFERENCE TO RELATED APPLICATION

The present application is related to and claims priority to U.S. Provisional Patent Application No. 62/418,421 filed Nov. 7, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present disclosure relates generally to the field of exercise and more specifically relates to exercise accessories.

2. Description of Related Art

Exercise straps have recently grown in popularity, particularly for abdominal training. Such exercise straps are usually made of nylon anchored to a fixed object and are of sufficient strength to support a person's weight. They generally consist of three components. On one end, there is the anchoring portion of the strap, usually a clip of some type. The middle portion is several feet of nylon strap to support a person's weight. At the other end, there is a handle. In a gym setting, exercise straps are typically anchored to the ceiling or a pull-up bar. The user usually fastens the suspension strap to the anchoring device by either wrapping the strap around the anchoring device or locking it into place with a clip hook connected directly to a closed loop anchor.

U.S. Pat. No. 8,858,408 to DeMeo relates to a double loop exercise strap. The described double loop exercise strap includes an outer strap anchored to a fixed object (e.g., a wall, rail or other fixed platform) and an inner strap that wraps firmly around a limb, extremity (e.g., hand or foot) or torso of the human body. The inner strap has two ends, a fixed end that may advantageously be sewn or attached to the outer strap and a free end that wraps around the human limb, extremity or torso and is threaded through an outer strap slot before being attached to the outside of the outer strap using VELCRO™, buckles or other types of fasteners to thereby create a closed double loop system.

BRIEF SUMMARY OF THE INVENTION

In view of the foregoing disadvantages inherent in the known exercise accessory art, the present disclosure provides a novel exercise accessory system and method. The general purpose of the present disclosure, which will be described subsequently in greater detail, is to provide an exercise accessory system and method.

An exercise accessory for a horizontal bar is disclosed herein. The exercise accessory for a horizontal bar includes a support hook configured to couple to the horizontal bar and to support at least 50 pounds from the horizontal bar, a hand grip coupled to the support hook and positioned adjacent to the support hook and an arm support coupled to the hand grip and positioned adjacent to the hand grip and opposite the support hook, the arm support configured to receive an arm of a user and to support the user via the arm of the user According to one embodiment, a method of using an exercise accessory is also disclosed herein. The method of using an exercise accessory includes clipping a support hook onto a horizontal bar, inserting an arm into an arm support (the arm support coupled to the support hook), resting an elbow in the arm support, placing a hand on a hand grip, the hand grip coupled to the support hook and interspersed between the support hook and the arm support, and using the exercise accessory to perform exercise. In one embodiment, the horizontal bar may be of a length configured to receive a plurality of exercise accessories and the exercise may be performed in a class setting. A further method of using an exercise accessory may include opening a carrying container, removing a plurality of tubular sections members, assembling the plurality of tubular sections members to create an exercise support (the exercise support including a first vertical support, a second vertical support, a first horizontal bar and a second horizontal bar), and clipping the support hook of the exercise accessory onto the first horizontal bar, or optionally the second horizontal bar.

For purposes of summarizing the disclosure, certain aspects, advantages, and novel features of the disclosure have been described herein. It is to be understood that not necessarily all such advantages may be achieved in accordance with any one particular embodiment of the disclosure. Thus, the disclosure may be embodied or carried out in a manner that achieves or optimizes one advantage or group of advantages as taught herein without necessarily achieving other advantages as may be taught or suggested herein. The features of the disclosure which are believed to be novel are particularly pointed out and distinctly claimed in the concluding portion of the specification. These and other features, aspects, and advantages of the present disclosure will become better understood with reference to the following drawings and detailed description.

BRIEF DESCRIPTION OF THE DRAWINGS

The figures which accompany the written portion of this specification illustrate embodiments and methods of use for the present disclosure, an exercise accessory system and method, constructed and operative according to the teachings of the present disclosure.

The various embodiments of the present disclosure will hereinafter be described in conjunction with the appended drawings, wherein like designations denote like elements.

DETAILED DESCRIPTION

As discussed above, embodiments of the present disclosure relate to an exercise accessory and more particularly to an exercise accessory, system and method as used to improve exercise accessories and systems.

Generally, disclosed herein are arm straps for hanging from a pull up bar, and illustrated being used for abdominal exercise. The arm straps are attached to the pull up bar via a clip, of which is wider and opens in such a way that it will clamp to any size pull up bar. The present disclosure may include a durable and sturdy grip between the clip and the strap in order to prevent damage from wear and tear no matter how many times they are used and no matter the body weight. The strap component may be composed of rubber, allowing for easy cleaning and no absorption of sweat, and is removable to allow for customization with various colors/designs. Also disclosed is a collapsible support system which provides a foldable, travel friendly pull up bar and arm strap combination for use in the home, or virtually anywhere.

Referring now more specifically to the drawings by numerals of reference, there is shown in FIGS. 1-4, various views of an exercise accessory 100.

Figure 1:
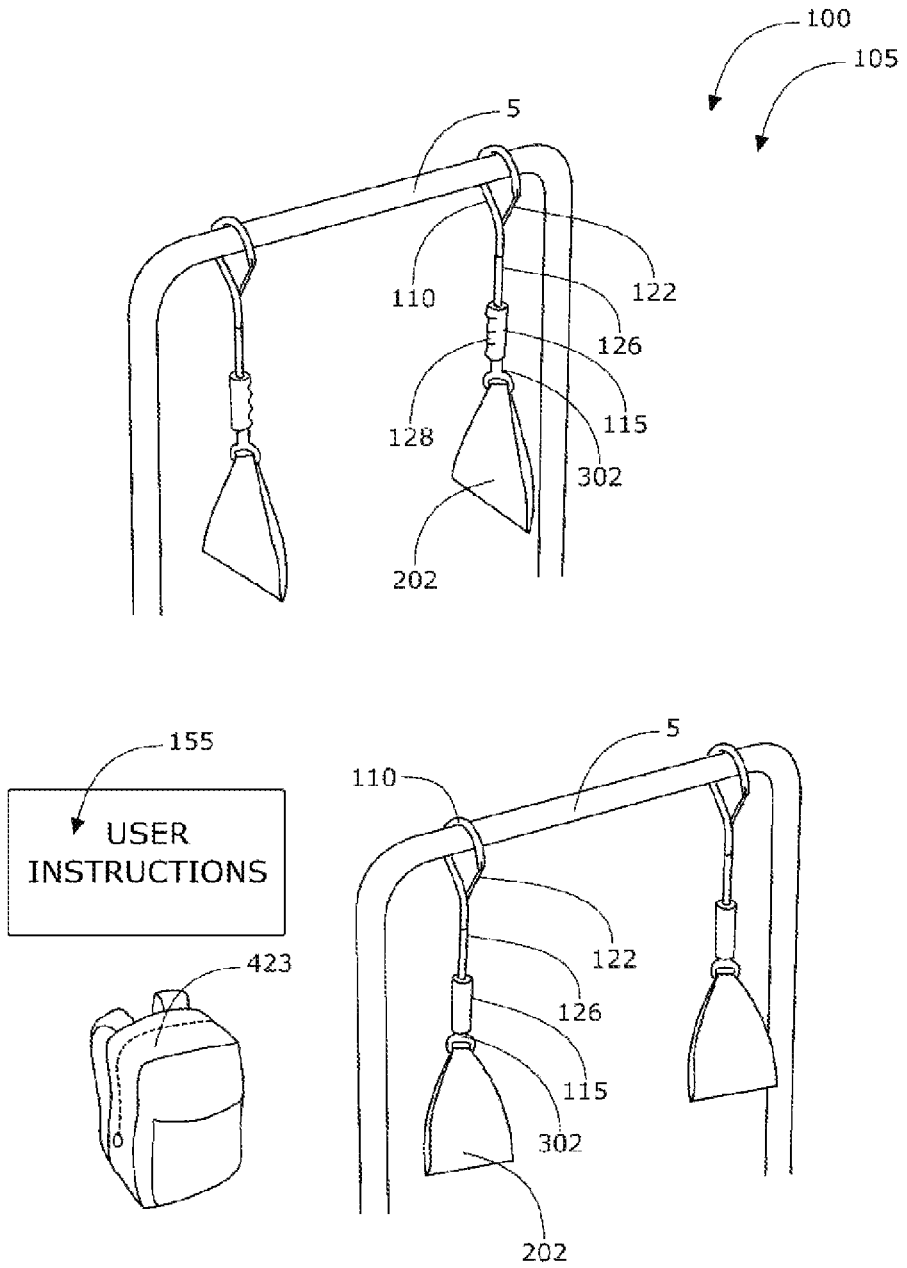
FIG. 1 is a perspective view of two exercise accessories, showing the exercise accessories locked into different orientations according to an embodiment of the present disclosure.

FIG. 1 shows two exercise accessories for a horizontal bar ("exercise accessory" 100) according to an embodiment of the present disclosure. Each exercise accessory 100 is illustrated locked into a plurality of orientations to target different muscle groups. As illustrated, the exercise accessory 100 may include a support hook 110, a hand grip 115, and an arm support 202.

Figure 2:
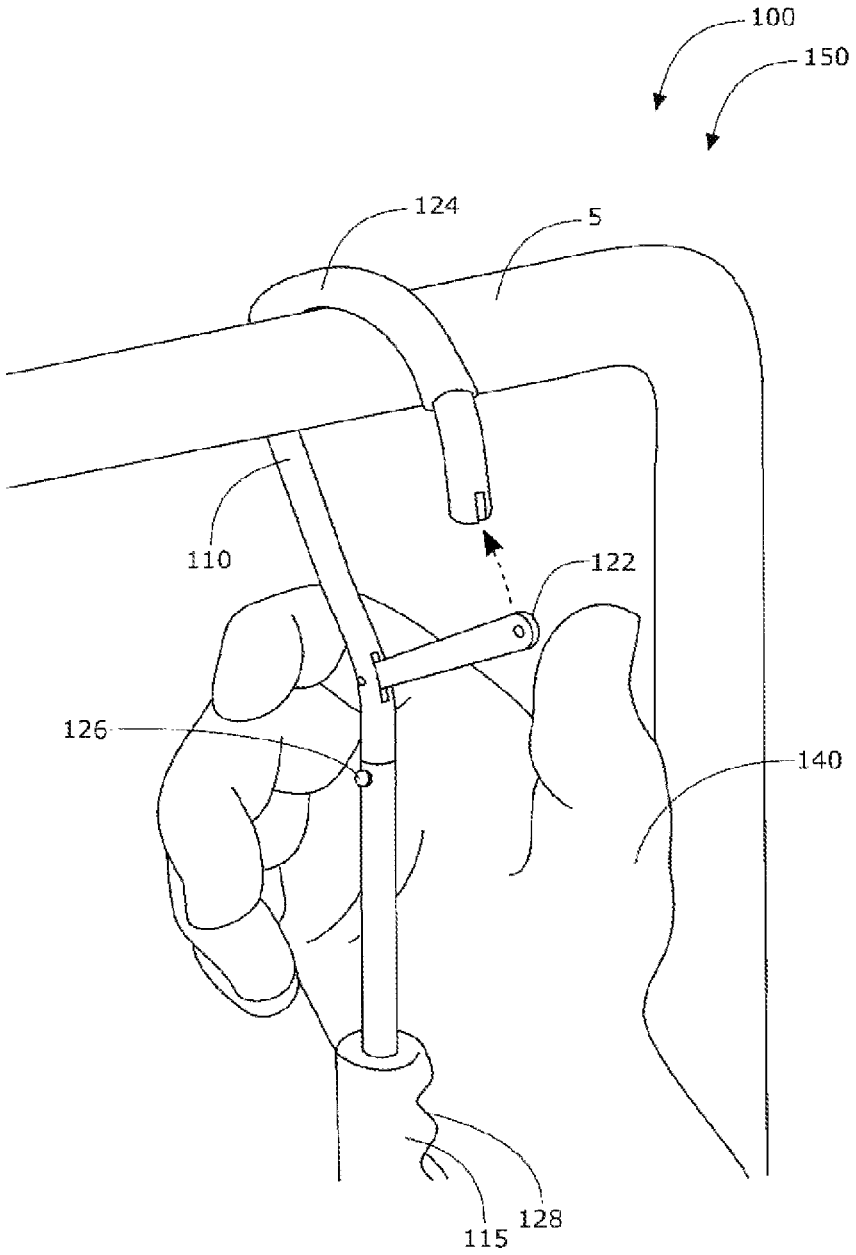
FIG. 2 is a perspective view of a portion of one of the exercise accessories of FIG. 1, during an 'in-use' condition, according to an embodiment of the disclosure.

According to one embodiment of the present disclosure, the hand grip 115 may be removably coupled to the support hook 110 via a first locking mechanism 126 (FIG. 2). Similarly, the arm support 202 may be removably coupled to the hand grip 115 via a second locking mechanism 302, and the hand grip 115 and the arm support 202 may be configured to couple to each other in a plurality of orientations via the first locking mechanism 126 and/or the second locking mechanism 302.

Here, each exercise accessory 100 may be beneficial for use by a user 140 (FIG. 2) to provide a means for performing abdominal exercise. Advantageously, this may overcome a shortcoming of the exercise accessories available today. Typically, when performing abdominal exercise with prior exercise accessories, a user must twist their body in order to target various muscle groups; particularly the oblique muscles. This can be uncomfortable and can cause pain to the user.

As above, each exercise accessory 100 may include the support hook 110 configured to couple to the horizontal bar 5, with the hand grip 115 coupled to the support hook 110 and positioned adjacent to the support hook 110, and the arm support 202 coupled to the hand grip 115 and positioned adjacent to the hand grip 115 and opposite the support hook 110. The arm support 202 may be configured to receive an arm of a user 140, and to support the user 140 via the arm of the user 140. Further, each exercise accessory 100 may be configured to support at least 50 pounds from the horizontal bar 5.

As illustrated, the hand grip 115 between the support hook 110 and the arm support 202 may resemble a smaller-scale bicycle handlebar grip. This hand grip 115 may be made of a strong, durable rubber material that can be easily cleaned. The hand grip 115 may be configured to allow a user to have a better grasp. The hand grips 115 may be further configured to be able to lock in different angles in order for users to be able to easily target the sides of their abdominals. Beneficially, the hand grip 115 may overcome the shortcomings of exercise accessories available on the market today. Generally, there are no exercise accessories with a hand grip on the straps for a user to grip onto. In examples where there is a hand grip, it is typically composed from a flimsy material. This accelerates the wear and tear of the strap as the hand grip bears the weight of a user.

The arm supports 202 may be uniquely made with a material to absorb sweat. The arm supports 202 may also be removable, for example, in order to be cleaned or replaced with straps of a different design. The arm supports 202 may be made from a firm, yet flexible, durable rubber that can be easily cleaned. The rubber may also absorb sweat for ease of use.

According to one embodiment, the exercise accessory 100 may be arranged as a kit 105. In particular, the exercise accessory 100 may further include a carrying container 423 and a set of instructions 155. The instructions may detail functional relationships in relation to the structure of the exercise accessory 100 (such that the exercise accessory 100 can be used, maintained, or the like, in a preferred manner).

FIG. 2 shows a partial view of an exercise accessory 100 of FIG. 1 during an 'in-use' condition 150, according to an embodiment of the present disclosure. As illustrated, the support hook 110 may include a spring-loaded gate 122 configured to bias in a closed position under a spring pressure, and to move (e.g., retract, extend, translate, etc.) into an open position when the spring pressure is overcome. Further, the spring-loaded gate 122 may be configured to open sufficiently to receive the horizontal bar 5. For example, the horizontal bar 5 may have a diameter between 1 inch and 3 inches, and the spring-loaded gate 122 and the support hook 110 may be dimensioned to receive and clip on said horizontal bar 5.

The support hook 110 may further include an anti-slip material 124 configured to resist slippage when the support hook 110 is coupled to the horizontal bar 5. For example, the anti-slip material 124 may include at least one of rubber, silicone, synthetic anti-slip polymers, and the like. The support hook 110 may have an advantage over previously known exercise accessories. This is because these previously known exercise accessories typically open inward, thus limiting the nature of apparatus that the exercise accessories can clip onto.

Figure 3A:
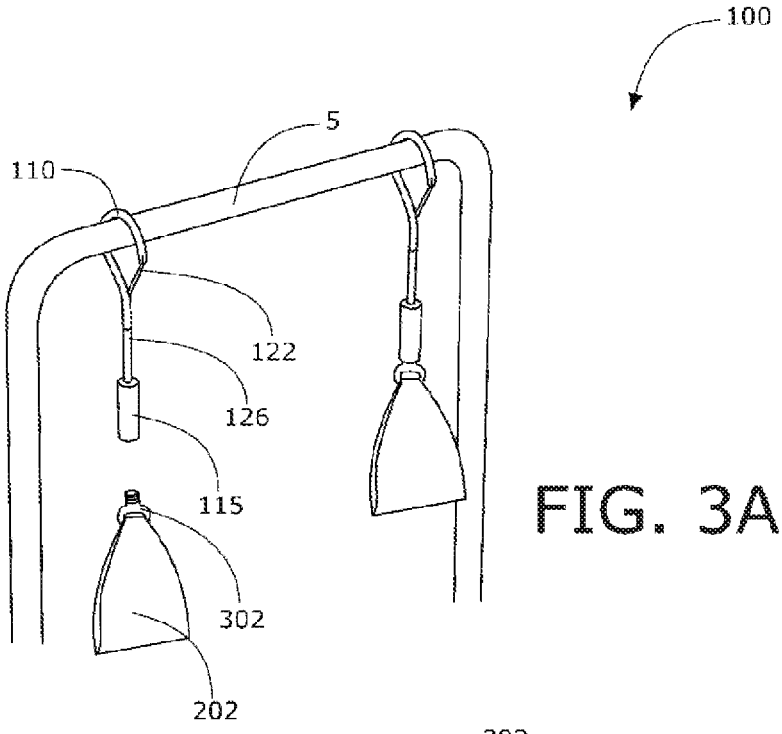
FIG. 3A is a perspective view of the exercise accessories of FIG. 1, showing an arm support detached from a hand grip according to an embodiment of the present disclosure.

FIG. 3A is a perspective view of the exercise accessories of FIG. 1, according to an embodiment of the present disclosure. Here, one arm support 202 is shown decoupled from one hand grip 115. According to one embodiment, the hand grip 115 may have a cylindrical shape including a plurality of finger receiving grooves 128 (FIG. 1) configured to provide the user 140 (FIG. 1) with additional gripping surface on the hand grip 115.

The hand grip 115 may be removably coupled to the support hook 110 via a first locking mechanism 126. Similarly, the arm support 202 may be removably coupled to the hand grip 115 via a second locking mechanism 302. Also, the hand grip 115 and the arm support 202 may be configured to couple to each other in a plurality of orientations via the first locking mechanism 126 and/or the second locking mechanism 302.

Figure 3B:
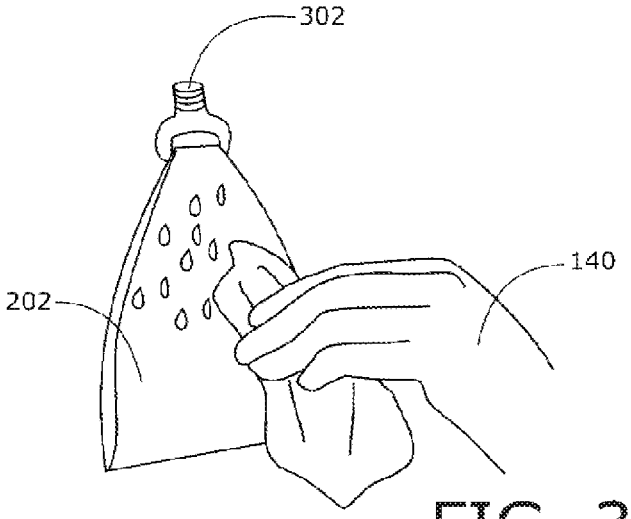
FIG. 3B is a perspective view of the exercise accessories of FIG. 3A, showing the arm support detached from the hand grip and being cleaned by a user according to an embodiment of the present disclosure.

FIG. 3B is a perspective view of the exercise accessories of FIG. 3A, showing the arm support detached from the hand grip and being cleaned by a user. Here, the arm support 202 is shown decoupled from the hand grip 115 and being cleaned by the user 140. This may overcome a disadvantage associated with prior exercise accessories. Generally, an arm support portion does not detach from a clip portion of an exercise accessory, meaning that the arm support portion cannot be readily removed and washed. Further, an arm support portion is usually made of a material that is not easily cleaned. This is an issue because, during strenuous exercise, the user will sweat into the arm support portion.

According to one embodiment of the present disclosure, the arm support 202 may be made of a durable rubber material. The durable rubber material may be sweat absorbent and easily cleaned. The arm support 202 may be removed from the hand grip 115 via the second locking mechanism 302 to enable cleaning. The arm support 202 may also be replaced. The arm supports 202 may be manufactured in a variety of designs.

Figure 4A:
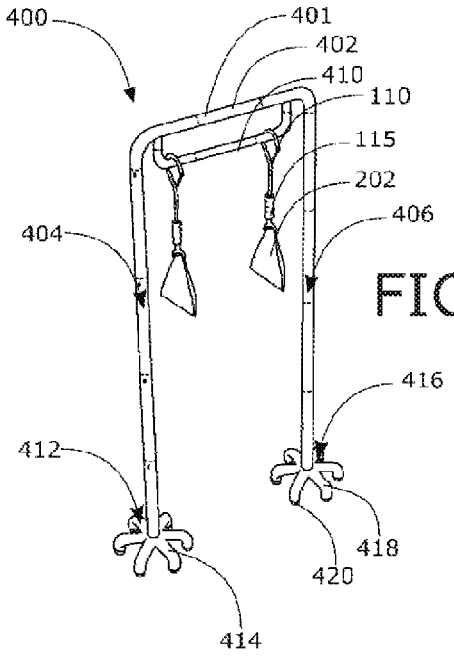
FIG. 4A is a perspective view of an exercise system, showing an exercise support and the exercise accessories of FIG. 1, according to an embodiment of the present disclosure.

FIG. 4A is a perspective view of an exercise system 400, according to an embodiment of the present disclosure. As illustrated, the exercise system 400 may include an exercise support 401 and a pair of exercise accessories 100.

The exercise support 401 may include a first horizontal bar 402, and the exercise support 401 may be configured to support at least 100 pounds hanging from the first horizontal bar 402. For example, the exercise support 401 may generally resemble a pull-up bar, wherein the pair of exercise accessories 100 may be clipped on to the first horizontal bar 402 of the exercise support 401 similar to FIG. 1. Also for example, as illustrated here, the exercise support 401 may further include a second horizontal bar 410 fixed to the first horizontal bar 402, and the pair of exercise accessories 100 may be clipped on to the second horizontal bar 410 of the exercise support 401

The exercise system 400 may further include a pair of exercise accessories 100 as described above and shown in FIG. 1. In particular, the exercise system 400 may further include a left support hook 110 configured to coupleable to the second horizontal bar 410 (and/or the first horizontal bar 402), and to support at least 50 pounds from the first horizontal bar 402, a left hand grip 115 coupled to the left support hook 110 and positioned adjacent to the left support hook 110 and a left arm support 202 coupled to the left hand grip 115 and positioned adjacent to the left hand grip 115 and opposite the left support hook 110, the left arm support 202 configured to receive a left arm of a user 140 and to support the user 140 via the left arm of the user 140.

Similarly, the exercise system 400 may further include a right support hook 110 configured to couple to the first horizontal bar 402 and to support at least 50 pounds from the first horizontal bar 402, a right hand grip 115 coupled to the right support hook 110 and positioned adjacent to the right support hook 110 and a right arm support 202 coupled to the right hand grip 115 and positioned adjacent to the right hand grip 115 and opposite the right support hook 110, the right arm support 202 configured to receive a right arm of the user 140 (not shown) and to support the user 140 via the right arm of the user 140. It is understood that each exercise accessory 100 may be interchangeable between "left" and "right".

The left hand grip 115 may be removably coupled to the left support hook 110 via a first left locking mechanism 126 (FIG. 2) and the right hand grip 115 may be removably coupled to the right support hook 110 via a first right locking mechanism 126. The left hand grip 115 and the right hand grip 115 may each have a cylindrical shape including a plurality of finger receiving grooves 128 (FIG. 2) configured to provide a user 140 with additional gripping surface on the left hand grip 115 and the right hand grip 115, respectively.

The left arm support 202 may be removably coupled to the left hand grip 115 via a second left locking mechanism 302 and the right arm support 202 may be removably coupled to the right hand grip 115 via a second right locking mechanism 302 (FIG. 1). The left hand grip 115 and the left arm support 202 may be configured to couple to each other in a plurality of orientations via the first left locking mechanism 126 and the second left locking mechanism 302. Similarly, the right hand grip 115 and the right arm support 202 may be configured to couple to each other in a plurality of orientations via the first right locking mechanism 126 and the second right locking mechanism 302. The left arm support 202 and the right arm support 202 may each be composed of a durable rubber material. The durable rubber material may be sweat absorbent and easily cleaned. The left arm support 202 may be removed from the left hand grip 115 via the second left locking mechanism 302, and the right arm support 202 may be removed from the right hand grip 115 via the second right locking mechanism to enable cleaning 302. The left arm support 202 and the right arm support 202 may also be replaced. The arm supports 202 may be manufactured in a variety of designs.

Figure 4B:
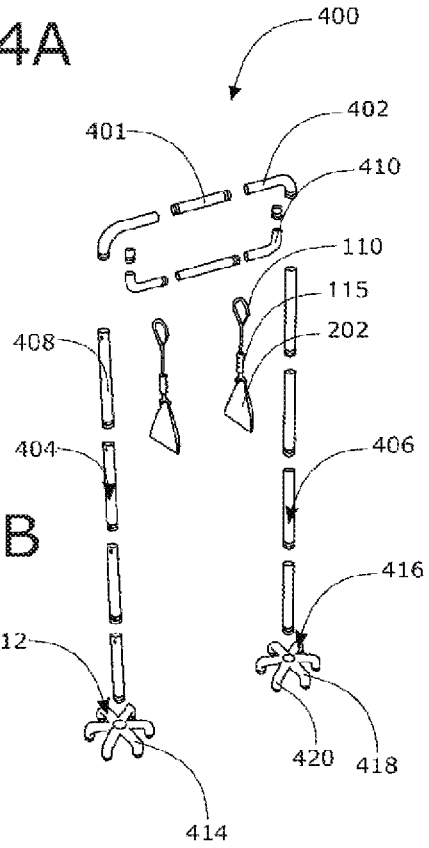
FIG. 4B is an exploded view of the exercise system of FIG. 4A, showing the exercise support having a plurality of tubular sections members according to an embodiment of the present disclosure.

FIG. 4B is an exploded view of the exercise system of FIG. 4A, illustrating one example of how the exercise support 401 may decouple. As shown, the exercise support 401 may include a first vertical support 404 and a second vertical support 406 configured together to elevate the first horizontal bar 402 in a horizontal orientation while supporting at least 100 pounds.

According to one embodiment, the exercise support 401 of the present disclosure may overcome the shortcomings of previously known exercise supports by providing a portable and collapsible exercise support 401 that is simple in construction, easily transported and stored and is designed for use with exercise accessories 100. In particular, the first and second vertical supports 404, 406 may each include a plurality of tubular section members 408, respectively, configured to couple together to form the first and second vertical support 404, 406, respectively, and to decouple for compact storage.

According to one embodiment, and as shown, the exercise support 401 may include a second horizontal bar 410 coupled to and supported by the first vertical support 404 and the second vertical support 406 via the first horizontal bar 402. In this illustrated embodiment, the pair of exercise accessories 100 may be coupled to and suspended from the second horizontal bar 410.

The exercise support 401 may further include a first base 412 and a second base 416 configured to contact a ground and provide a stable base for the first vertical support 404 and the second vertical support 406, respectively. According to one embodiment, the first base 412 may include a first plurality of legs 414, and the second base 416 may include a second plurality of legs 418. Each of the first plurality of legs 414 and the second plurality of legs 418 may be configured to contact a ground and provide a more stable base for the exercise support 401.

As illustrated, the first base 412 may be removably attached to the bottom end of the first vertical support 404, and the second base 416 may be removably attached to the bottom end of the second vertical support 406, respectively. The first plurality of legs 414 and the second plurality of legs 418 may include an anti-slip material 420 configured to resist slippage on the ground when weight is hanging from the first horizontal bar 402 or the second horizontal bar 410. The anti-slip material 420 may be at least one of rubber, silicone, synthetic anti-slip polymers.

Figure 4C:
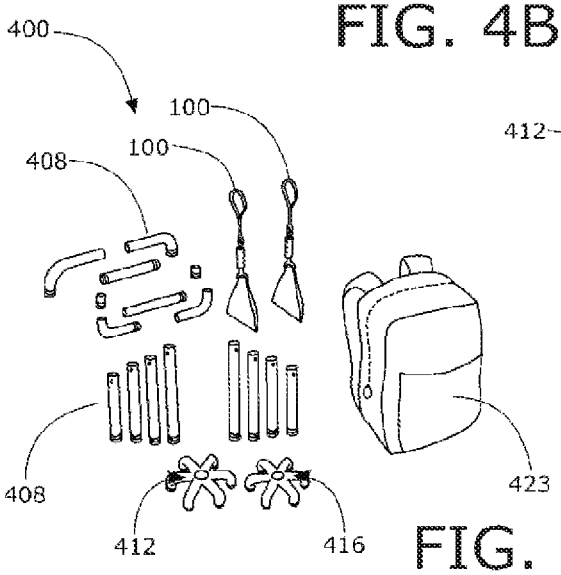
FIG. 4C is an exploded view of the exercise system of FIG. 4A, showing the exercise support decoupled for compact storage, and a carrying container according to an embodiment of the present disclosure.

FIG. 4C is an exploded view of the exercise system of FIG. 4A, illustrating the exercise support 401 decoupled for compact storage. Also, as discussed above, the exercise system 400 may further include a carrying container 423 and a set of instructions. Further, the exercise system 400 may be arranged as a kit 105 (FIG. 1). In one example, the carrying container 423 may be a backpack. The backpack may be composed of a sturdy, durable fabric.

Components of the exercise system 400 (e.g., individual pieces making up first horizontal bar 402, first vertical support 404, second vertical support 406, second horizontal bar 410, first base 412, second base 416) may be made from light metal or other suitable material and may be easily assembled and disassembled with foldable parts. The exercise system 400 may also be strong enough to allow users to do pull up exercises as well. The parts may be stored or transported in a backpack, made from durable fabric, when not in use.

Figure 5:
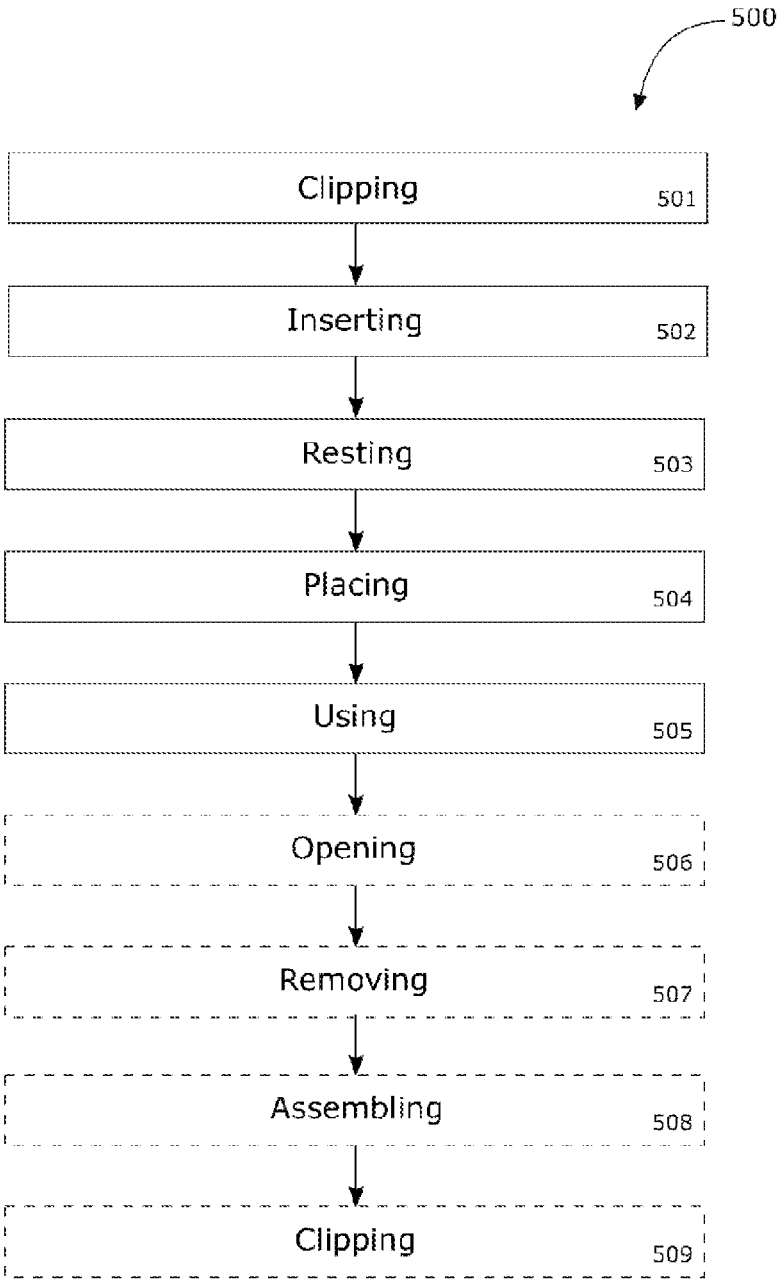
FIG. 5 is a flow diagram illustrating a method of using an exercise accessory, according to an embodiment of the present disclosure.

FIG. 5 is a flow diagram illustrating a method for using an exercise accessory, according to an embodiment of the present disclosure. In particular, the method for using an exercise accessory 500 may include one or more components or features of the exercise accessory 100 or the exercise system 400, both as described above.

As illustrated, the method for using an exercise accessory 500 may include the steps of: step one 501, clipping a support hook onto a horizontal bar; step two 502, inserting an arm into an arm support (the arm support coupled to the support hook); step three 503, resting an elbow in the arm support; step four 504, placing a hand on a hand grip (the hand grip coupled to the support hook and interspersed between the support hook and the arm support); and step five 505, using the exercise accessory to perform exercise.

The method for using an exercise accessory 500 may further include the optional steps of: step six 506, opening a carrying container; step seven 507, removing a plurality of tubular section members; step eight 508, assembling the plurality of tubular section members to create an exercise support (the exercise support including a first vertical support, a second vertical support, a first horizontal bar and a second horizontal bar); and step nine 509, clipping the support hook of the exercise accessory onto the first horizontal bar, and optionally the second horizontal bar.

According to another embodiment, the method for using an exercise accessory 500 may include providing a horizontal bar of a length configured to receive a plurality of pairs of exercise accessories 100, and exercise may be performed in a class setting. Beneficially, this embodiment may allows trainers to see everyone and make sure they have proper form. Further, it may also allow people to see each other and motivate each other.

It should be noted that steps 506-509 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using an exercise accessory (e.g., different step orders within above-mentioned list, elimination or addition of certain steps, including or excluding certain maintenance steps, etc.), are taught herein.

The embodiments of the disclosure described herein are exemplary and numerous modifications, variations and rearrangements can be readily envisioned to achieve substantially equivalent results, all of which are intended to be embraced within the spirit and scope of the disclosure. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An exercise accessory for a horizontal bar, the exercise accessory comprising:

a support hook configured to couple to the horizontal bar and to support at least 50 pounds from the horizontal bar;

a linear shank coupled to the support hook, the linear shank being rigid;

a molded tubular hand grip circumscribing the linear shank and coupled to the support hook and positioned adjacent to the support hook;

a rigid eyelet affixed to the linear shank;

an arm support coupled to the hand grip and positioned adjacent to the hand grip and opposite the support hook, the arm support comprising a unitary flexible panel joined at opposite ends into a bight, the arm support being affixed to the rigid eyelet, the arm support configured to receive an arm of a user and to support the user via the arm of the user.

2. The exercise accessory of claim 1, wherein the support hook includes a spring-loaded gate configured to bias in a closed position under a spring pressure, and to move into an open position when the spring pressure is overcome.

3. The exercise accessory of claim 2, wherein the spring-loaded gate is further configured to open sufficiently to receive the horizontal bar.

4. The exercise accessory of claim 3, wherein the horizontal bar has a diameter between 1 inch and 3 inches, and the spring-loaded gate and the support hook are dimensioned to receive and clip on said horizontal bar.

5. The exercise accessory of claim 4, wherein the support hook includes an anti-slip material configured to resist slippage when the support hook is coupled to the horizontal bar.

6. The exercise accessory of claim 1, further comprising a first-threaded fastener coupling the linear shank to the support hook.

7. The exercise accessory of claim 6, wherein the hand grip has a cylindrical shape including a plurality of finger receiving grooves configured to provide a user with additional gripping surface on the hand grip.

8. The exercise accessory of claim 7, further comprising a second-threaded fastener removably coupling the linear shank to the eyelet.

9. The exercise accessory of claim 1, wherein the arm support is composed of a durable rubber material.

10. An exercise system comprising:

an exercise support including a first horizontal bar, the exercise support configured to support at least 100 pounds hanging from the first horizontal bar;

a left support hook configured to couple to the first horizontal bar and to support at least 50 pounds from the first horizontal bar;

a left linear shank coupled to the support hook, the left linear shank being rigid;

a left molded tubular hand grip circumscribing the linear shank and coupled to the left support hook and positioned adjacent to the left support hook;

a left rigid eyelet affixed to the left linear shank;

a left arm support coupled to the left hand grip and positioned adjacent to the left hand grip and opposite the left support hook, the left arm support comprising a left unitary flexible panel joined at opposite ends into a left bight, the left arm support being affixed to the left rigid eyelet, the left arm support configured to receive a left arm of a user and to support the user via the left arm of the user;

a right support hook configured to couple to the first horizontal bar and to support at least 50 pounds from the first horizontal bar;

a right linear shank coupled to the support hook, the right linear shank being rigid;

a right molded tubular hand grip circumscribing the linear shank and coupled to the right support hook and positioned adjacent to the right support hook;

a right rigid eyelet affixed to the right linear shank;

a right arm support coupled to the right hand grip and positioned adjacent to the right hand grip and opposite the right support hook, the right arm support comprising a right unitary flexible panel joined at opposite ends into a right bight, the right arm support being affixed to the right rigid eyelet, the right arm support configured to receive a right arm of a user and to support the user via the right arm of the user; and wherein the left support hook includes a left spring-loaded gate configured to bias in a first closed position under a first spring pressure, and to retract into a first open position when the first spring pressure is overcome;

wherein the right support hook includes a right spring-loaded gate configured to bias in a second closed position under a second spring pressure, and to retract into a second open position when the second spring pressure is overcome;

wherein the left spring-loaded gate and the right spring-loaded gate are further configured to open sufficiently to receive the horizontal bar;

wherein the horizontal bar has a diameter between 1 inch and 3 inches;

wherein the left spring-loaded gate and the left support hook and the right spring-loaded gate and the right support hook and are each dimensioned to receive and clip on said horizontal bar;

wherein the left support hook includes an anti-slip material configured to resist slippage when the left support hook is coupled to the horizontal bar;

wherein the right support hook includes an anti-slip material configured to resist slippage when the right support hook is coupled to the horizontal bar;

wherein the left hand grip is removably coupled to the left support hook via a first left locking mechanism;

wherein the right hand grip is removably coupled to the right support hook via a first right locking mechanism;

wherein the left hand grip and the right hand grip each have a cylindrical shape including a plurality of finger receiving grooves configured to provide a user with additional gripping surface on the left hand grip and the right hand grip, respectively;

wherein the left arm support is removably coupled to the left hand grip via a second left locking mechanism;

wherein the right arm support is removably coupled to the right hand grip via a second right locking mechanism;

wherein the left hand grip and the left arm support are configured to couple to each other in a plurality of orientations via the first left locking mechanism and the second left locking mechanism;

wherein the right hand grip and the right arm support are configured to couple to each other in a plurality of orientations via the first right locking mechanism and the second right locking mechanism; and wherein the left arm support and the right arm support are each composed of a durable rubber material.

11. The exercise system of claim 10, exercise support further includes a first vertical support and a second vertical support, the first vertical support and the second vertical support configured together to elevate the first horizontal bar in a horizontal orientation while supporting the at least 100 pounds.

12. The exercise system of claim 11, wherein the first and second vertical supports each include a plurality of tubular sections members, respectively, the plurality of tubular member configured to couple together to form the first and second vertical supports, respectively, and to decouple for compact storage.

13. The exercise system of claim 12, wherein the exercise support includes a second horizontal bar coupled to and supported by the first vertical support and the second vertical support together; and wherein the first horizontal bar is coupled to and suspended from the second horizontal bar.

14. The exercise system of claim 13, wherein the exercise support includes a first base having a first plurality of legs and a second base having a second plurality of legs, the first plurality of legs and the second plurality of legs configured for contacting a ground, the first base removably attached to a first base-end of the first vertical support, and the second base removably attached to a second base-end of the vertical frame member.

15. The exercise system of claim 14, wherein the first plurality of legs and the second plurality of legs include an anti-slip material configured to resist slippage on the ground when weight is hanging from the first horizontal bar.

16. The exercise system of claim 15, further comprising a carrying container; and a set of instructions; and wherein the exercise system is arranged as a kit.

* * * * *